US005090395A

United States Patent [19]

Gannon

[11] Patent Number: 5,090,395

[45] Date of Patent: Feb. 25, 1992

[54] SETTING GAUGE FOR COMPOUND BOW

[76] Inventor: William Gannon, 715 County Rd. #7, Clifton Springs, N.Y. 14432

[21] Appl. No.: 640,967

[22] Filed: Jan. 14, 1991

[51] Int. Cl.[5] ..... F41B 5/00

[52] U.S. Cl. ..... 124/25.6; 124/231; 124/86; 116/282

[58] Field of Search ..... 124/23.1, 24.1, 25, 124/25.6, 80, 86, 88; 411/8, 14, 394, 402; 116/212, 261, 281, 282, 290

[56] References Cited

U.S. PATENT DOCUMENTS

| | | | |
|---|---|---|---|
| 997,648 | 7/1911 | Cavanagh et al. | 116/282 X |
| 1,234,021 | 7/1917 | Harrington et al. | 116/282 |
| 2,056,490 | 10/1936 | Skaraas et al. | 116/282 X |
| 3,814,075 | 6/1974 | Hoyt | 124/23.1 |
| 4,091,790 | 5/1978 | Hoyt | 124/24.1 |
| 4,494,521 | 1/1985 | Quartino | 124/23.1 |
| 4,685,848 | 8/1987 | Langer | 411/102 |

FOREIGN PATENT DOCUMENTS

| | | | |
|---|---|---|---|
| 19498 | 2/1977 | Japan | 124/23.1 |

*Primary Examiner*—Randolph A. Reese
*Assistant Examiner*—John A. Ricci
*Attorney, Agent, or Firm*—Herbert Dubno; Andrew Wilford

[57] ABSTRACT

A compound bow has a body having a pair of ends each carrying a respective limb and with a bolt extending between each limb and the respective body end is provided with a draw-weight gauge for each limb. Each gauge has a gear head on the respective bolt. A holder adjacent the respective bolt rotatably supports a threaded rod extending along an axis generally perpendicular to the respective bolt. A gear on the rod is in constant mesh with the gear head on the respective bolt. A scale is fixed on the bow along the rod and an indicator threaded onto the rod can be displaced thereby along the scale.

4 Claims, 1 Drawing Sheet

SETTING GAUGE FOR COMPOUND BOW

FIELD OF THE INVENTION

The present invention relates to a compound bow. More particularly this invention concerns a system for determining the setting of the limbs of the bow.

BACKGROUND OF THE INVENTION

A standard compound bow has a central body and a pair of limbs mounted at the ends of the body and limitedly pivotal thereon about parallel axes transverse to the body and limbs. Each limb is secured to the body inward from its pivot by a respective threaded bolt which is tightened to establish the relative angular position of the limb and the body. The outer ends of the limbs are interconnected by the bow string.

The draw weight, which determines the tension of the bow string, is changed by means of the bolts securing the limbs to the body. To increase the draw weight they are screwed in or tightened and to decrease it they are backed off.

It is absolutely essential that both limbs of the bow be set identically. Otherwise the center of the bow string will not move back perfectly on center when pulled back, and the bow will be out of tune and will not be accurate.

Hence the user of the bow must keep careful track of exactly how many times each limb bolt is turned, and must be sure that both limb bolts are turned the same number of turns. The settings for the bows must be recorded so they can be duplicated after loosening for storage or replacement of a bow string. Such a procedure is fairly onerous.

OBJECTS OF THE INVENTION

It is therefore an object of the present invention to provide an improved system for keeping track of the limb settings for a compound bow.

Another object is the provision of such an improved system for keeping track of the limb settings for a compound bow which overcomes the above-given disadvantages, that is which allows the user to easily establish any desired setting.

SUMMARY OF THE INVENTION

The instant invention is a gauge used with a compound bow having a body in turn having a pair of ends each carrying a respective limb and with a bolt extending between each limb and the respective body end. The gauge has a gear head on the respective bolt. A holder adjacent the respective bolt rotatably supports a threaded rod extending along an axis generally perpendicular to the respective bolt. A gear on the rod is in constant mesh with the gear head on the respective bolt. A scale is fixed on the bow along the rod and a pointer threaded onto the rod can be displaced thereby along the scale.

Thus with the system of this invention each gauge provides an exact readout of the setting of the respective limb of the bow. The user need merely tighten each bolt to produce identical settings without having to keep track of just how many turns of the bolt have been executed. Once completed it is easy to determine the draw-weight setting of the bow simply with a glance at the gauges.

According to further feature of this invention the gear head and the gear are interfitting bevel gears. Furthermore the gear head on the bolt has more teeth than the gear of the rod so that the gauge can provide an accurate readout of less than a full turn of the bolt. A spring is braced between the gear on the rod and the holder to urge the gear into mesh with the gear head of the bolt. This allows the two gears to be disengaged for initial calibration of the gauge.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
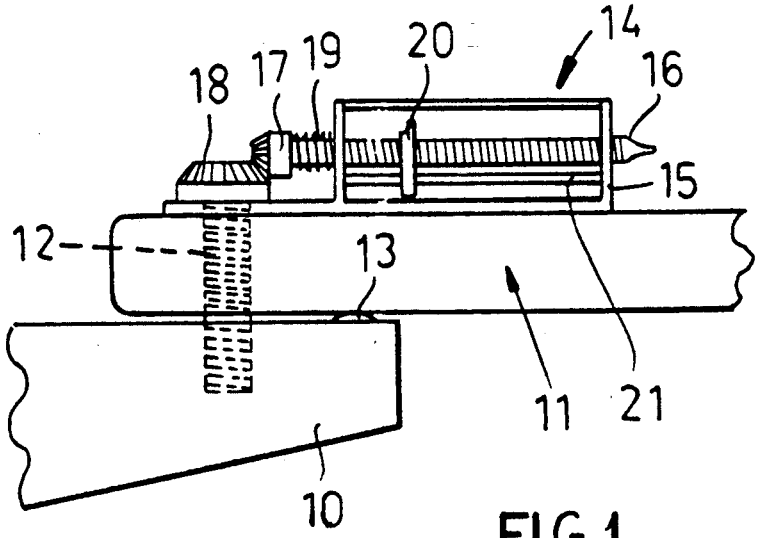
FIG. 1 is a side view of a portion of a bow and a gauge according to this invention.
Figure 2:
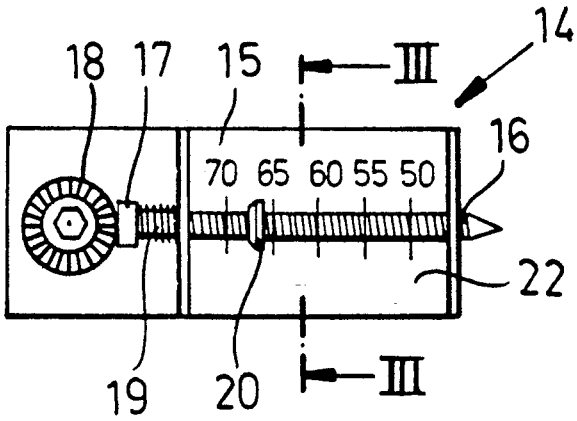
FIG. 2 is a top view of the gauge of FIG. 1.
Figure 3:
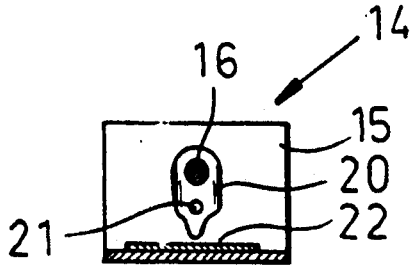
FIG. 3 is a section taken along line III—III of FIG. 2.

As seen in FIG. 1 a compound bow has a body 10 on each end (only one shown) of which is pivoted a limb 11. A bolt 12 is secured between t he limb 11 and the body 10 offset from the pivot 13 between them. This structure is all standard.

According to this invention a gauge 14 for providing a direct readout of the setting determined by the bolt 13 includes a metal frame 15 secured to the limb 11 adjacent the bolt 13. A threaded rod 16 is rotatable in the frame 15 about an axis perpendicular to that of the bolt 13 and carries on one end a bevel-gear head 17 meshing with another such bevel-gear head 18 carried on the head of the bolt 12. A spring 19 braced between the frame 15 and the head 17 keeps the two heads 17 and 18 in mesh with each other so that rotation of the bolt 13 will be reflected in rotation of the rod 16. Since the head 17 is smaller than the head 18, there will be a step up with the rod 16 rotating more than the bolt 13.

A pointer 20 constituted as an element threaded onto the rod 15 is prevented from rotating with the rod 16 by a guide wire 21 parallel to the rod 16. Underneath the pointer 20 on the frame 15 is a scale 22 carrying indicia. Thus as the rod 16 is rotated by the bolt 13 the pointer 20 will be screwed along this rod 16, next to the scale 22. This therefore gives a direct linear readout of the setting of the respective limb of the bow.

The gauge according to this invention can be retrofitted relatively easily on each limb of an existing compound bow and will provide an accurate readout of the exact setting of the respective limb. Thus when the bow is restrung, or a different draw weight needs to be set, it is a relatively easy matter to establish the desired settings in both limbs. The step up between the bolt 13 and the rod 16 ensures that even partial turns of the bolt 13 will be accurately counted, making it extremely easy to establish a very accurate setting.

I claim:

1. In combination with a compound bow having a body having a pair of ends each carrying a respective limb, with a bolt extending between each limb and the respective body end, a gauge at each body end comprising:

a gear head on the respective bolt;

a holder adjacent the respective bolt;

a threaded rod rotatable in the holder about an axis generally perpendicular to the respective bolt;

a gear on the rod meshing with the gear head on the respective bolt;

a scale fixed on the bow along the rod; and a pointer threaded onto the rod and displaceable thereby along the scale.

2. The combination defined in claim 1 wherein the gear head and the gear are interfitting bevel gears.

3. The combination defined in claim 1 wherein the gear head on the bolt has more teeth than the gear of the rod.

4. The combination defined in claim 1, further comprising a spring braced between the gear on the rod and the holder and urging the gear into mesh with the gear head of the bolt.

* * * * *